US010604955B1

(12) United States Patent
Goettl et al.

(10) Patent No.: US 10,604,955 B1
(45) Date of Patent: Mar. 31, 2020

(54) IN-FLOOR SWIMMING POOL NOZZLE HOUSING WITH OUTER BEVELED EDGE

(71) Applicant: GSG Holdings, Inc., Chandler, AZ (US)

(72) Inventors: Steven J. Goettl, Phoenix, AZ (US); John Goettl, Phoenix, AZ (US); Steven J. Goettl, II, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 0 days.

(21) Appl. No.: 16/181,217

(22) Filed: Nov. 5, 2018

(51) Int. Cl.
*E04H 4/16* (2006.01)

(52) U.S. Cl.
CPC ..... *E04H 4/169* (2013.01)

(58) Field of Classification Search
CPC .. E04H 4/169; E04H 4/12; E04H 4/14; B05B 15/70
USPC ..... 4/488–513; 239/203–206
See application file for complete search history.

(56) References Cited

U.S. PATENT DOCUMENTS 3,149,784 A * 9/1964 Skidgel ..... B05B 3/007 239/206
3,675,252 A 7/1972 Ghiz
3,845,729 A 11/1974 von Berlichingen
4,300,246 A 11/1981 Gould
4,322,860 A * 4/1982 Gould ..... E04H 4/169 134/167 R
4,371,994 A 2/1983 Mathews
4,939,797 A * 7/1990 Goettl ..... E04H 4/169 4/490
5,251,343 A * 10/1993 Goettl ..... B05B 15/70 4/490
6,301,723 B1 * 10/2001 Goettl ..... E04H 4/169 239/204
6,367,098 B1 * 4/2002 Barnes ..... E04H 4/169 4/490
6,393,629 B1 * 5/2002 Barnes ..... E04H 4/169 4/490
6,438,766 B1 8/2002 Capdevila Arnau et al.
6,601,244 B1 * 8/2003 Goettl ..... E04H 4/169 239/204
7,571,496 B2 8/2009 Martin
7,979,924 B1 * 7/2011 Goettl ..... E04H 4/169 239/236

(Continued)

FOREIGN PATENT DOCUMENTS

DE 102009033038 11/2012

OTHER PUBLICATIONS

NeenahCatalog, http://www.nfco.com/nfco/NeenahCatalog.pdf.

(Continued)

*Primary Examiner* — Benjamin R Shaw
(74) *Attorney, Agent, or Firm* — McCarter & English, LLP

(57) ABSTRACT

A housing for an in-floor swimming pool cleaning nozzle includes a first end with connection lugs configured to receive and engage corresponding lugs on an in-floor swimming pool nozzle, and a second end with a wall extending axially with a leading edge having a thickness that narrows from the leading edge toward a ledge. The thickness narrows due to a beveled outer surface of the wall and presents a smaller leading edge that shows less than a non-beveled leading edge when placed in a floor of a swimming pool.

20 Claims, 20 Drawing Sheets

(56) References Cited

U.S. PATENT DOCUMENTS

| | | | | |
|---|---|---|---|---|
| 8,308,081 | B1 * | 11/2012 | Goettl | E04H 4/169 239/204 |
| 8,533,874 | B1 | 9/2013 | Goettl | |
| 8,959,739 | B1 * | 2/2015 | Goettl | E04H 4/169 29/407.04 |
| 8,984,677 | B1 | 3/2015 | Lopez | |
| 9,148,007 | B2 | 9/2015 | Drane | |
| 9,267,303 | B1 * | 2/2016 | Goettl | E04H 4/00 |
| 9,624,683 | B1 | 4/2017 | Shah | |
| 2004/0040221 | A1 | 3/2004 | Airheart | |
| 2004/0194201 | A1 * | 10/2004 | Goettl | E04H 4/169 4/491 |
| 2008/0148500 | A1 | 6/2008 | Riberio | |
| 2009/0000021 | A1 * | 1/2009 | Martin | E04H 4/169 4/490 |
| 2018/0142486 | A1 * | 5/2018 | Goettl | B05B 15/70 |

OTHER PUBLICATIONS http://www.oneontablock.com/PDFS/CIMHF3.pdf.
http://fryreglet.com/downloads_productresources/Reveals+Moldings.pdf.
https://plasticomponents.com/product/aesthetic-drywall-reveal.
International Search Report of the International Searching Authority dated Dec. 13, 2019, issued in connection with International Application No. PCT/US2019/059697 (3 pages).
Written Opinion of the International Searching Authority dated Dec. 13, 2019, issued in connection with International Application No. PCT/US2019/059697 (3 pages).

* cited by examiner

IN-FLOOR SWIMMING POOL NOZZLE HOUSING WITH OUTER BEVELED EDGE

TECHNICAL FIELD

Aspects of this document generally relate to an in-floor swimming pool nozzle housing, and more particularly to an in-floor swimming pool nozzle housing with an outer edge that is beveled to reduce visibility when positioned in a swimming pool floor.

BACKGROUND

Pool cleaning systems are used in swimming pools to remove dirt and debris from the water in the swimming pool. Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface. The pool nozzle housing surrounds the pop up cleaning nozzle within the plaster of the pool floor and is surrounded by the plaster.

SUMMARY

According to an aspect, a housing for an in-floor swimming pool cleaning nozzle, consisting essentially of a hollow, single piece molded cylindrical body comprising a first end having an outer diameter sized to fit within an end of a swimming pool cleaning system water pressure supply pipe and an inner diameter sized to receive an end of an in-floor swimming pool cleaning nozzle, the first end having a plurality of nozzle connection lugs extending inward of an inner surface of the first end, the plurality of nozzle connection lugs configured to engage corresponding lugs on the in-floor swimming pool cleaning nozzle, and a second end diametrically enlarged compared with the first end and sized to receive an in-floor swimming pool cleaning nozzle, wherein the second end having a wall extending axial to the cylindrical body at the second end and forming a leading edge of the second end, the leading edge having a thickness of ⅛" or less at the leading edge, the wall comprising a flange that extends radially from the cylindrical body, an outer surface of the wall being gradually beveled from the thickness of less than ⅛" at the leading edge to a thickness at least twice as thick as the thickness at the leading edge as the wall extends away from the leading edge toward the flange, an inner surface of the wall adjacent the leading edge being non-beveled and parallel to a central axis of the cylindrical body.

Particular embodiments may comprise one or more of the following freatures. The leading edge of the second end may have a thickness of 1/16" or less. The leading edge of the second end may have a thickness of 1/32" or less. The outer surface of the wall may be gradually beveled from the leading edge of the second end to a depth on the wall measured from the leading edge that is less than half of a distance from the leading edge to the flange. The outer surface of the wall may be gradually beveled from the leading edge of the second end to a depth on the wall measured from the leading edge toward the flange that is equal to or greater than a largest thickness of the wall between the leading edge and the flange. The outer surface of the wall may be gradually beveled from the leading edge of the second end until the flange extends radially from the wall. The wall may extend axially toward the first end past the flange such that the flange extends radially from the cylindrical body from the wall.

According to an aspect, a housing for an in-floor swimming pool cleaning nozzle, the housing comprising a hollow, molded body comprising a cylindrical first end having an outer diameter sized to fit within an end of a swimming pool cleaning system water pressure supply pipe and an inner diameter sized to receive an end of an in-floor swimming pool cleaning nozzle, the first end comprising at least one nozzle connector extending inward of an inner surface of the first end, the at least one nozzle connector configured to engage the in-floor swimming pool cleaning nozzle, and a second end wider than the outer diameter of the first end and sized to receive an in-floor swimming pool cleaning nozzle, wherein the second end comprises a wall extending axial to the cylindrical first end and forming a leading edge of the second end, the wall comprising a flange that extends perpendicular to the wall, an outer surface of the wall being beveled from its narrowest point at the leading edge to a thickness greater than the thickness at the leading edge as the wall extends away from the leading edge toward the flange, an inner surface of the wall immediately adjacent the leading edge being non-beveled and parallel to a central axis of the cylindrical body.

Particular embodiments may comprise one or more of the following features. The wall of the second end extending toward the flange gradually bevels outward to a thickness of at least twice as large as the thickness at the leading edge. The leading edge of the second end may have a thickness 1/16" or less. The leading edge of the second end may have a thickness of 1/32" or less. The outer surface of the wall may be gradually beveled from the leading edge of the second end to a depth on the wall measured from the leading edge toward the flange that is equal to or greater than a largest thickness of the wall between the leading edge and the flange. The depth to which the outer surface of the wall is gradually beveled is at least half of a distance from the leading edge to the flange. The outer surface of the wall may be gradually beveled from the leading edge of the second end until the flange extends radially from the wall. The wall extends axially toward the first end past the flange such that the flange extends perpendicular from the wall.

According to an aspect, a housing for an in-floor swimming pool cleaning nozzle comprising a hollow, cylindrical body molded as a single piece of material having a first end with an outer diameter sized to fit within an end of a swimming pool cleaning system water pressure supply pipe and an inner diameter sized to receive an end of an in-floor swimming pool cleaning nozzle and engage the in-floor swimming pool cleaning nozzle with at least one nozzle connector extending inward from the inner surface of the first end, and a second end with an outer diameter wider than the outer diameter of the first end, the second end forming wall having a leading edge that is beveled on an outer surface of the wall immediately adjacent the leading edge such that a thickness of the wall immediately adjacent the leading edge is less than a thickness of the wall farther from the leading edge, and the leading edge is non-beveled on an inner surface of the wall immediately adjacent the leading edge, the second end further comprising a continuous annular flange extending radially outward of the wall.

Particular embodiments may comprise one or more of the following features. The wall of the second end extending toward the flange may gradually bevel outward to a thickness of at least twice as large as the thickness at the leading edge. The leading edge of the second end may have a thickness 1/16" or less. The leading edge of the second end may have a thickness of 1/32" or less. The outer surface of the wall may be gradually beveled from the leading edge to a depth on the wall measured from the leading edge toward the flange that is equal to or greater than a largest thickness of the wall between the leading edge and the flange.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

The present disclosure will now be described by way of example, with reference to the accompanying drawings.

Figure 1A:
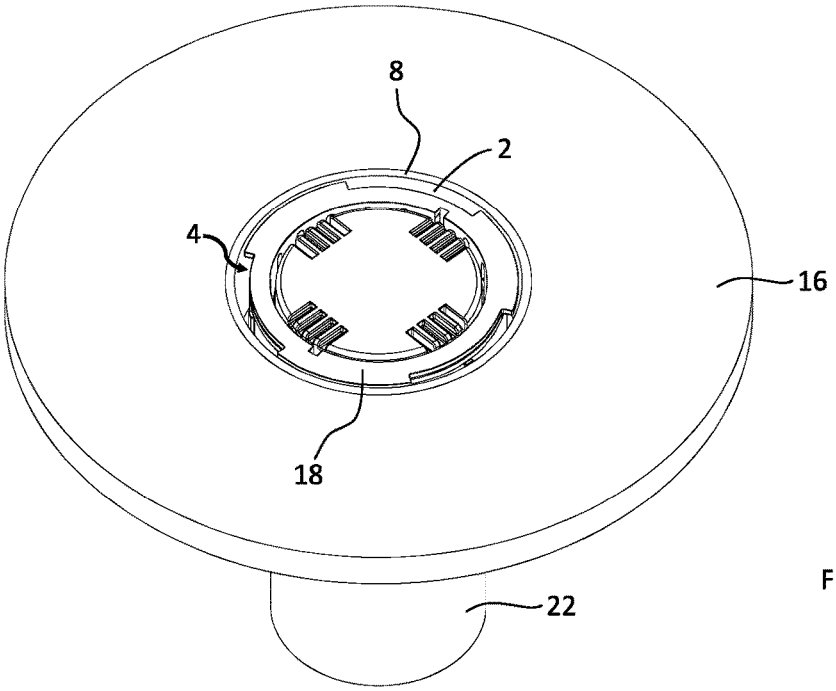
FIG. 1A (Prior Art)
FIG. 1A is a perspective view of a conventional in-floor cleaning nozzle mounted in a swimming pool floor in a housing with a flat leading edge.
Figure 1B:
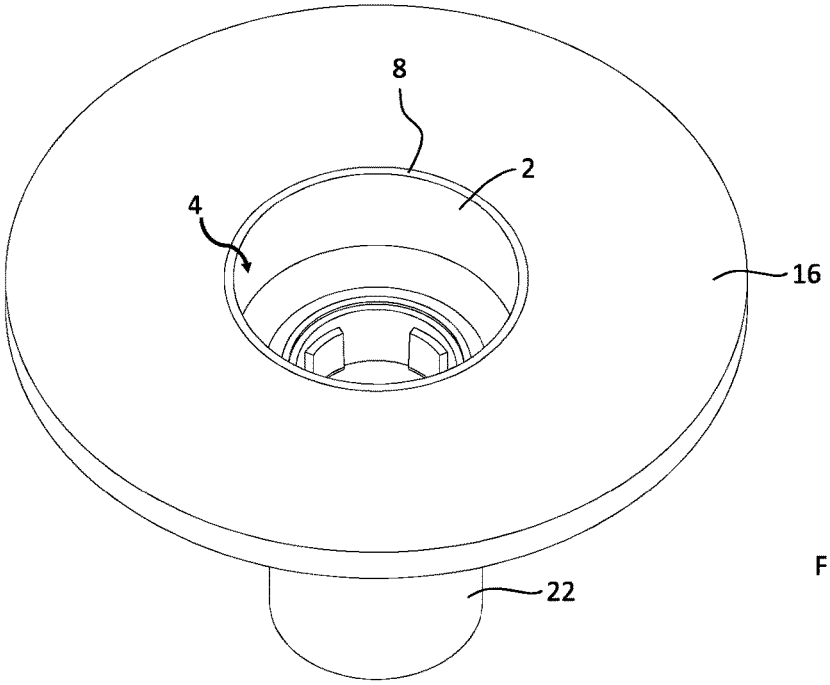
FIG. 1B (Prior Art)
FIG. 1B is a perspective view of the housing of FIG. 1A with the in-floor cleaning nozzle removed.
Figure 1C:
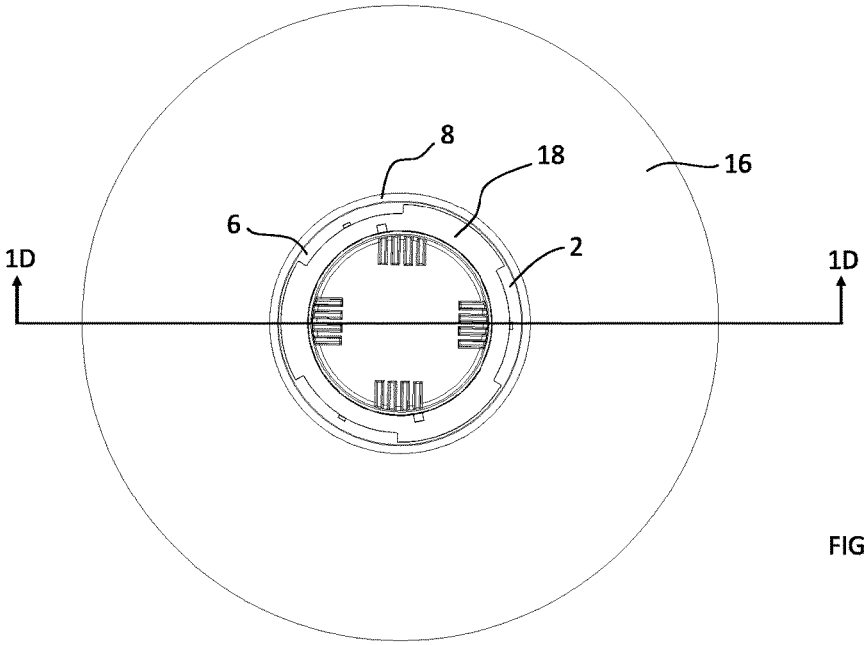
FIG. 1C (Prior Art)
FIG. 1C is a top view of the in-floor cleaning nozzle and housing of FIG. 1A.
Figure 1D:
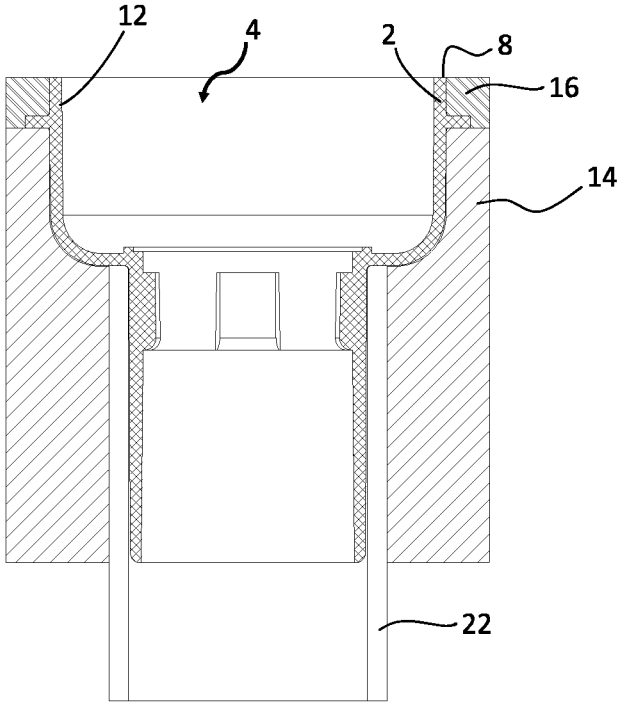
FIG. 1D (Prior Art)
FIG. 1D is a cross-sectional view of the in-floor cleaning nozzle housing of FIG. 1C taken along cross-sectional line 1D-1D emphasizing the straight leading edge of the housing.
Figure 2A:
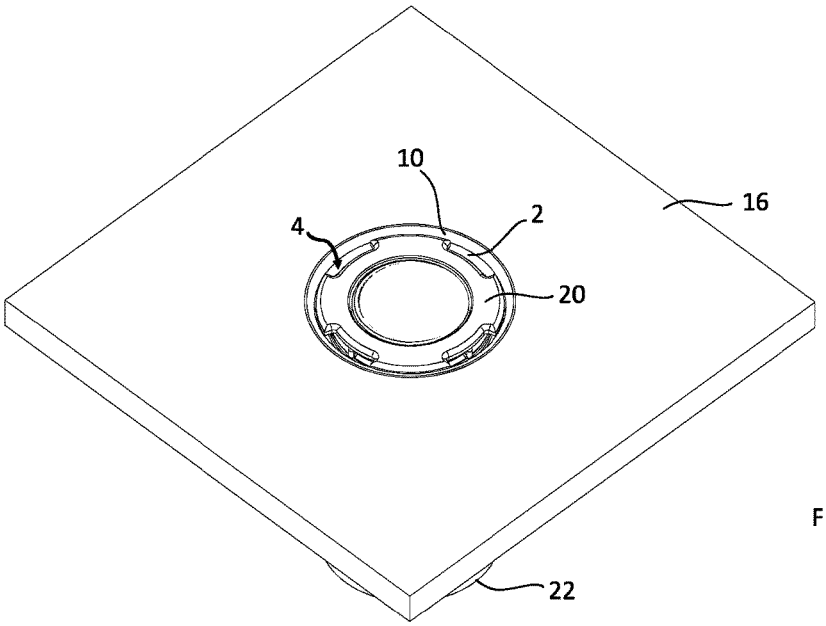
FIG. 2A (Prior Art)
FIG. 2A is a perspective a conventional in-floor cleaning nozzle mounted in a swimming pool floor in a housing with an internally rounded leading edge.
Figure 2B:
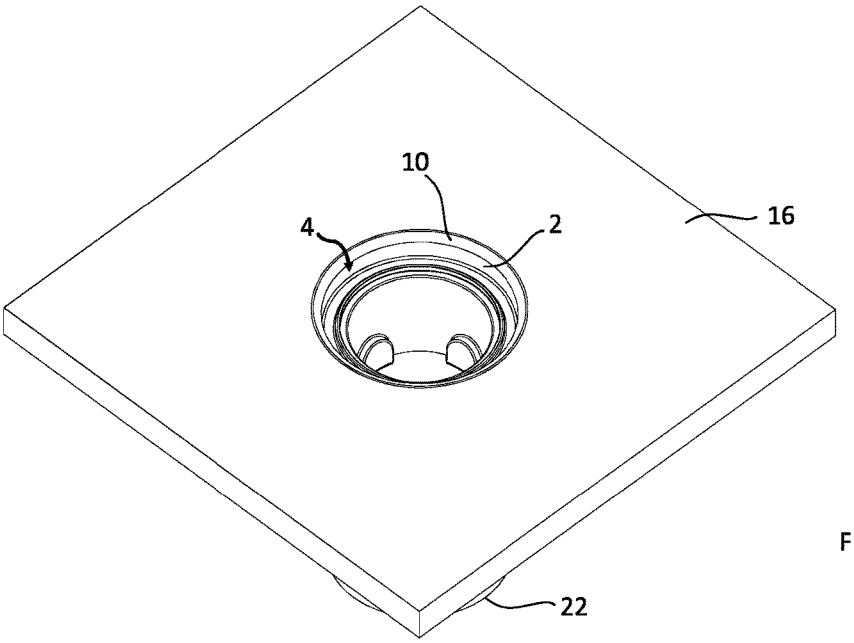
FIG. 2B (Prior Art)
FIG. 2B is a perspective view of the housing of FIG. 2A with the in-floor cleaning nozzle removed.
Figure 2C:
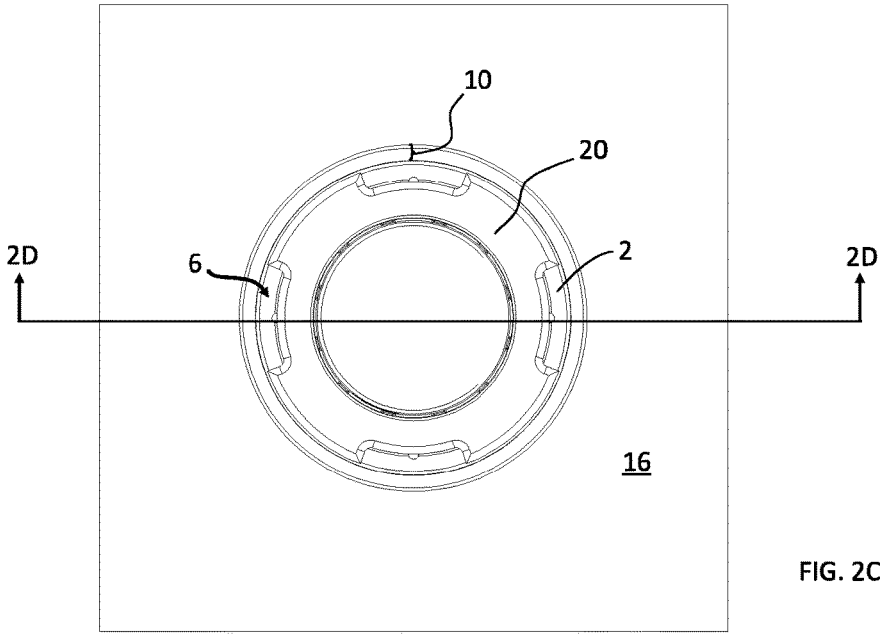
FIG. 2C (Prior Art)
FIG. 2C is a top view of the in-floor cleaning nozzle and housing of FIG. 2A.
Figure 2D:
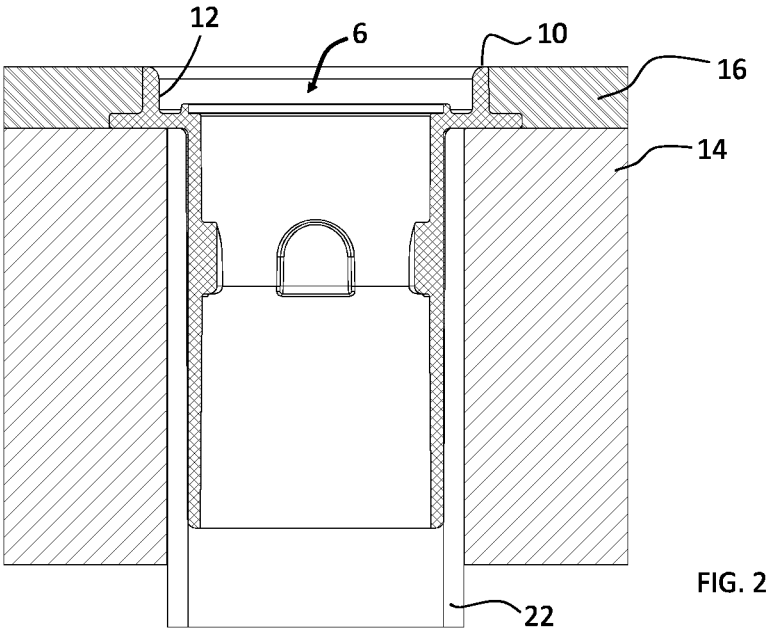
FIG. 2D (Prior Art)
FIG. 2D is a cross-sectional view of the in-floor cleaning nozzle housing of FIG. 2C taken along cross-sectional line 2D-2D emphasizing the internally curved leading edge of the housing.
Figure 3A:
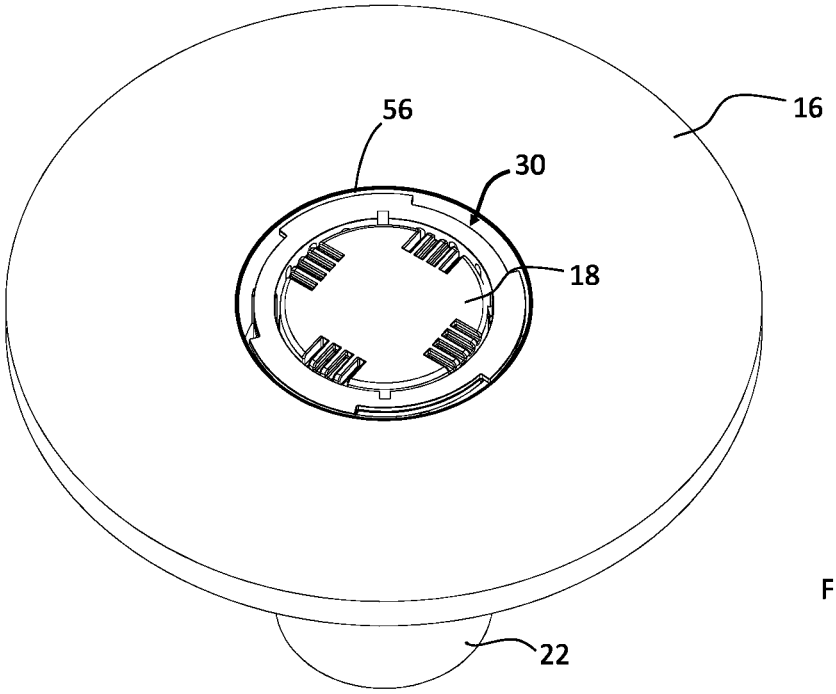
FIG. 3A is an in-floor cleaning nozzle mounted in a swimming pool floor in a first housing embodiment with an externally beveled leading edge.
Figure 3B:
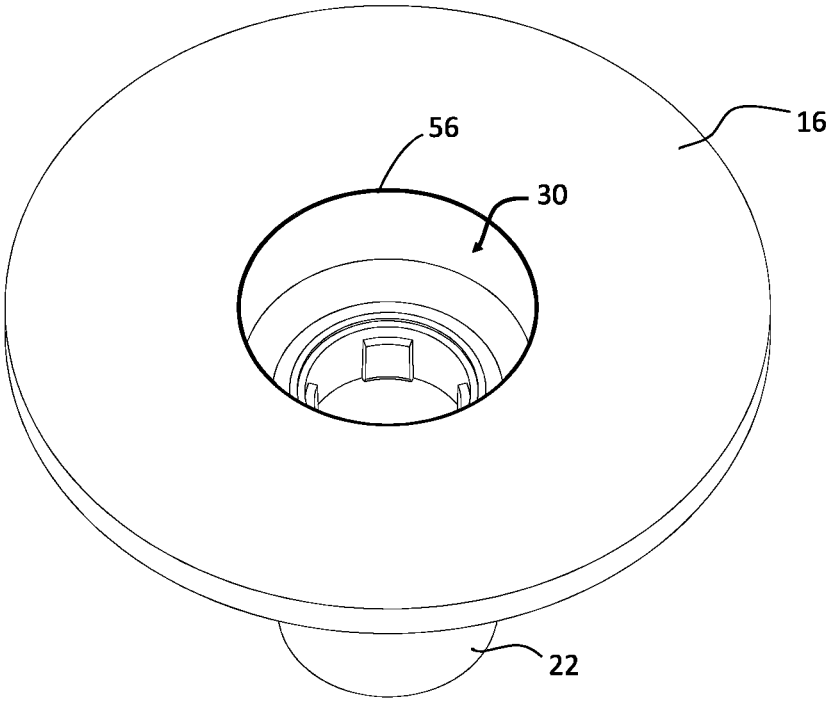
FIG. 3B is a perspective view of the housing of FIG. 3A with the in-floor cleaning nozzle removed.
Figure 3C:
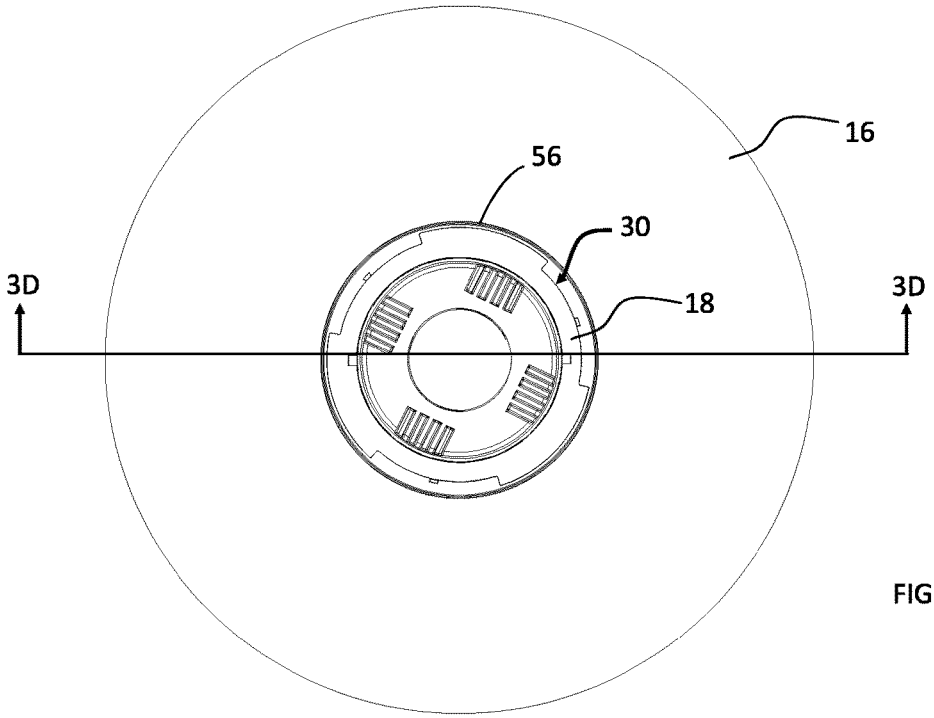
FIG. 3C is a top view of the in-floor cleaning nozzle and housing of FIG. 3A.
Figure 3D:
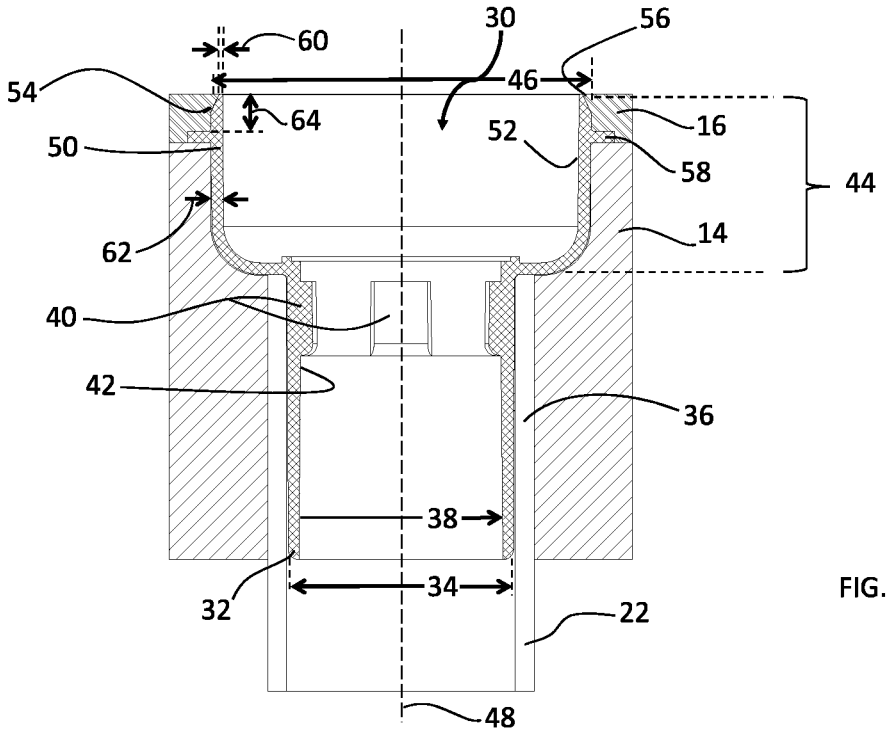
FIG. 3D is a cross-sectional view of the in-floor cleaning nozzle housing of FIG. 3C taken along cross-sectional line 3D-3D emphasizing the externally beveled leading edge of the housing.
Figure 3E:
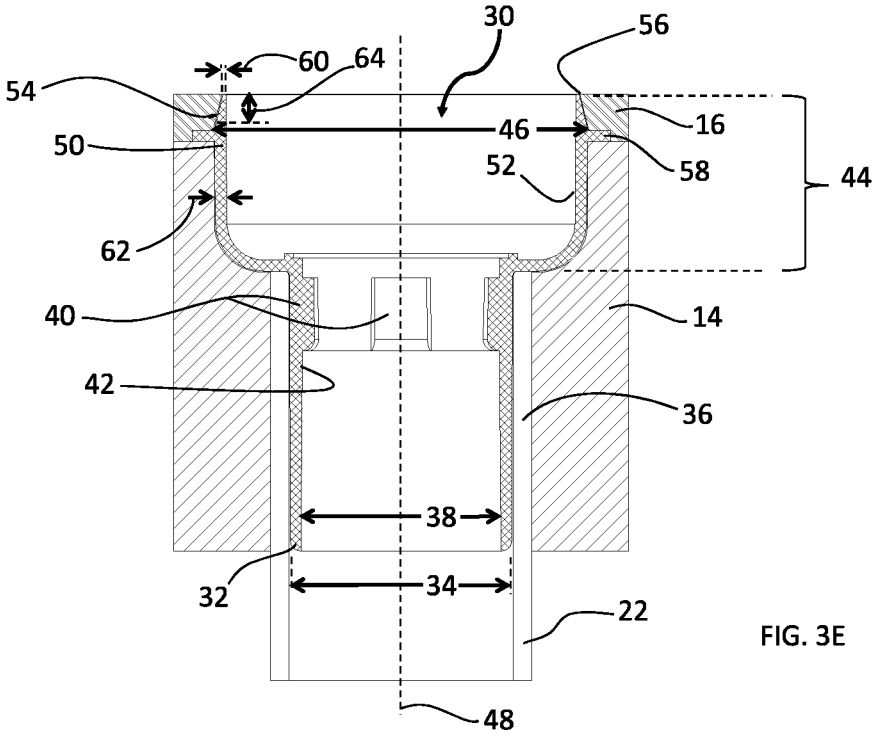
FIG. 3E is a cross-sectional view of the in-floor cleaning nozzle housing of FIG. 3C taken along cross-sectional line 3D-3D emphasizing the externally beveled leading edge of the housing with a steeper bevel than in FIG. 3D.

While the present disclosure will be described in connection with the preferred embodiments shown herein, it will be understood that it is not intended to limit the disclosure to those embodiments. On the contrary, it is intended to cover all alternatives, modifications, and equivalents, as may be included within the spirit and scope of the disclosure as defined by the appended claims.

DETAILED DESCRIPTION

While this disclosure is susceptible of embodiments in many different forms, there is shown in the drawings and will herein be described in detail embodiments of the disclosure with the understanding that the present disclosure is to be considered as an exemplification of the principles of the disclosure and is not intended to limit the broad aspect of the disclosure to the embodiments illustrated.

With reference to the prior art in-floor swimming pool cleaning head and housing of FIGS. 1A-1D and FIGS. 2A-2D, the outer wall 2 on a conventional pool cleaning head housing body 4, 6 includes either a flat leading edge 8 (see FIGS. 1A-1D) or a leading edge 10 that is rounded on the transition from the leading edge 10 to the inside surface 12 of the wall 2 to assist in guiding the cleaning head nozzle into the housing body 6 (see FIGS. 2A-2D). The housing body 4, 6 is mounted within an end of a swimming pool cleaning system water pressure supply pipe 22 that is coupled to a pool pump (not shown). When the housing body 4, 6 is surrounded by concrete 14 that is covered with a plaster 16 layer flush with the leading edge 8, 10 of the housing body 4, 6, the leading edge 8, 10 of the housing body 4, 6 is visible on the floor of the pool for all of the leading edge 8, 10 that is not covered with plaster to the start of the nozzle 18, 20. The color of that exposed housing body 4, 6 is important to the aesthetics of the product and many swimming pool owners want that exposed housing body 4, 6 to match the plaster 16 and/or the nozzle 18, 20 rather than being a different color. Examples of conventional swimming pool cleaning systems are shown and described in U.S. Pat. No. 8,533,874 to Goettl, issued Sep. 17, 2013 and U.S. Pat. No. 6,393,629 to Barnes et al., issued May 28, 2002, the disclosures of each of which are hereby incorporated herein by reference.

Conventionally, to overcome the complaints of mismatched colors on the pool floor caused by the exposed leading edge 8, 10 of the housing body 4, 6, the housing body 4, 6 can be manufactured from materials having the same color as the nozzle 18, 20 and/or plaster 16. Having housing bodies 4, 6 that are the colors of all of the nozzle 18, 20 and/or plaster 16 possibilities, however, is expensive to manufacture and store compared with a single color. Alternatively, color-match rings have been used which are placed over the leading edge of the housing body to cover the leading edge and change it to a desired matching color. The color-match rings, however, are known to break, are more likely to come off of the housing body because they are a separate piece, and still require storage and installation of a second component and are, therefore, more expensive to manufacture than if not used.

FIGS. 3A-3E and 4A-4E illustrate applications of the present housing body improvements to reduce the exposure of the leading edge color-mismatch without the necessity of providing a rainbow of color-matching housing bodies and without the need for a rainbow of color-match rings to match different combinations of nozzle and plaster colors. FIGS. 3A-3E illustrate application of the improvements to a first, deep-body housing style, and FIGS. 4A-4E illustrate application of the improvements to a second, shallow-body housing style. Which housing style is used depends upon which nozzle style is needed for a particular application, but the principles disclosed herein can be applied to any housing style for any nozzle style in the same way, as explained in more detail below. In both of the housing styles, the body of the nozzle 18, 20 in its retracted position is flush, or nearly flush, with the leading edge 56, 96 of the housing body 30, 70 so that the nozzle 18, 20 does not create a catch point or tripping point on the surface of the swimming pool, and helps to minimize nozzle visibility without the nozzle overlapping the nozzle body (see also FIG. 5).

FIGS. 3A-3E illustrate an in-floor swimming pool cleaning nozzle with a single piece molded cylindrical housing body 30. The housing body 30 of this disclosure can be formed as a single piece of all the same material, including all of its sub-components, rather than being formed as multiple separate, or separately formed and then joined, body components. As used herein, single piece means a single piece of all the same material that is formed as a single piece rather than formed separately and then joined. The housing body 30 has a first end 32 having an outer diameter 34 sized to fit within an end 36 of a swimming pool cleaning system water pressure supply pipe 22. The first end 32 of the housing body 30 also includes an inner diameter 38 that is sized to receive an end of an in-floor swimming pool cleaning nozzle 18. The in-floor swimming pool cleaning nozzle 18 engages with the housing body 30 under pressure through a plurality of nozzle connection lugs 40 extending inward of the inner surface 42 of the first end 32.

A second end 44 of the housing body 30 includes an outer wall 50 extending parallel to the central axis 48 of the housing body 30. The outer wall 50 includes an inner surface 52, an outer surface 54, a leading edge 56 and flange 58 that extends outward from the outer wall 50. Although, as illustrated in FIGS. 3A-3E, the outer wall 50 of the housing body 30 is in most cases formed cylindrical to conform with tradition and to fit conventional in-floor swimming pool shapes, the cylindrical shape is not strictly required and the second end 44 may be formed any shape and dimension necessary to receive an appropriately configured in-floor swimming pool cleaning nozzle. However, for purposes of this disclosure, the examples will be provided as a cylindrical shape with corresponding terminology.

The second end 44 includes an outer diameter 46, or other outer width dimension for non-cylindrical shapes, larger than the outer diameter 34 of the first end 32, the outer diameter 46 sized large enough to receive the in-floor swimming pool cleaning nozzle 18. Unlike a conventional leading edge of a housing body, the leading edge 56 of the housing body 30 of FIGS. 3A-3E is formed with a tapered end, the outer surface 54 of the wall 50 having a thickness 60 less than ⅛" at the leading edge 56 that is beveled outward from its narrowest point at the leading edge 56 to a thickness 62 that is greater than the thickness at the leading edge 56 as the wall 50 extends away from the leading edge toward the flange 58. The flange 58 extends radially outward from the wall 50 in particular embodiments, such as that shown in FIGS. 3A-3E. In particular embodiments, the flange 58 extends perpendicular to the wall 50. The inner surface 52 of the wall adjacent the leading edge and opposite the beveled portion of the outer surface 54 is non-beveled and parallel to the central axis 48 of the housing body 30. In particular embodiments, the leading edge 56 has a thickness 60 of 1/16" or less. In other particular embodiments, the leading edge 56 has a thickness 60 of 1/32" or less.

Figure 6A:
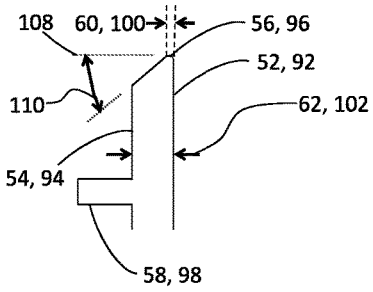
FIGS. 6A-6C are close-up views of a leading edge of the housing to illustrate the range of slope for the beveled edge.
Figure 6B:
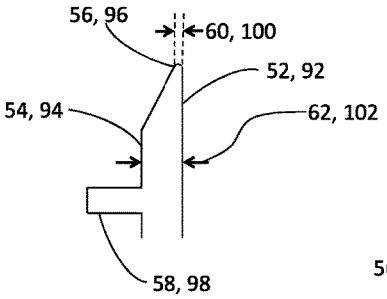
Figure 6C:
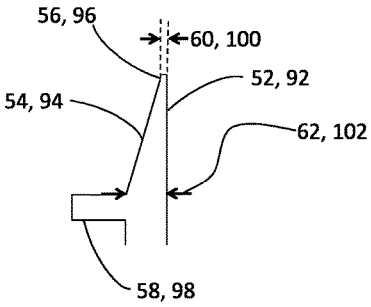

In particular embodiments, the thickness 60 at the leading edge 56 is beveled outward through the outer surface 54 to a thickness 62 at least twice as thick as the thickness 60 at the leading edge 56. In some embodiments, the outer surface 54 is gradually beveled at the leading edge 56 from its larger thickness 62 to a narrower thickness 60 at the leading edge 56. In other embodiments, the outer surface 54 may increase in thickness 60, 62, irregularly or not consistently as it extends toward the flange. The outer surface 54 of the wall 50 is beveled from the leading edge 56 of the wall 50 to a depth 64 on the wall 50 between the leading edge 56 and the flange 58. In some embodiments, the depth 64 on the wall 50 is equal to or greater than a largest thickness of the wall 62 between the leading edge 56 and the flange 58. In particular embodiments, that depth 64 is at least half of a distance from the leading edge 56 to the flange 58 (see, for example, FIG. 3D). In other embodiments, the depth 64 is equal to the distance from the leading edge 56 to the flange 58 so that the bevel on the outer surface 54 extends to the flange 58 (see, for example, FIG. 3E). In particular embodiments, the amount of the bevel on the outer surface 54 may vary between a minimum bevel at 45 degrees (FIG. 6A) to a medium bevel (FIG. 6B) to a maximum bevel (FIG. 6C) and anywhere in between. For embodiments where the bevel angle 110 with respect to the plane perpendicular 108 to the inner surface 52 is less than 45 degrees, the plaster 16 of the pool floor may be unstable and tend to crack. Although it is not required in all embodiments, by providing a bevel angle 110 of 45 degrees or more, the plaster 16 is more stable. However, by fully beveling the outer surface 54 of the leading edge 56 all the way to the flange 58, the housing body 30 is least stable due to the thinner wall thickiness 62 extending longer near the leading edge 56. Those of ordinary skill in the art will be able to determine an appropriate bevel angle 110 for the materials used for the housing body 30 and the plaster 16.

FIGS. 4A-4E illustrate an in-floor swimming pool cleaning nozzle with a single piece molded cylindrical housing body 70. The housing body 70 is the same in all respects to the housing body 30 of FIGS. 3A-3E in its formation, materials and function except that it has a more shallow depth for the housing body 70 to accommodate a shallower in-floor cleaning nozzle 20. Nevertheless, the description will be repeated here for completeness, with reference to FIGS. 4A-4E. The housing body 70 of this disclosure can be formed as a single piece of all the same material, including all of its sub-components, rather than being formed as multiple separate, or separately formed and then joined, body components. As used herein, single piece means a single piece of all the same material that is formed as a single piece rather than formed separately and then joined. The housing body 70 has a first end 72 having an outer diameter 74 sized to fit within an end 76 of a swimming pool cleaning system water pressure supply pipe 22. The first end 72 of the housing body 70 also includes an inner diameter 78 that is sized to receive an end of an in-floor swimming pool cleaning nozzle 20. The in-floor swimming pool cleaning nozzle 20 engages with the housing body 70 under pressure through a plurality of nozzle connection lugs 80 extending inward of the inner surface 82 of the first end 72.

A second end 84 of the housing body 70 includes an outer wall 90 extending parallel to the central axis 88 of the housing body 70. The outer wall 90 includes an inner surface 92, an outer surface 94, a leading edge 96 and flange 98 that extends outward from the outer wall 90. Although, as illustrated in FIGS. 4A-4E, the outer wall 90 of the housing body 70 is in most cases formed cylindrical to conform with tradition and to fit conventional in-floor swimming pool shapes, the cylindrical shape is not strictly required and the second end 84 may be formed any shape and dimension necessary to receive an appropriately configured in-floor swimming pool cleaning nozzle. However, for purposes of this disclosure, the examples will be provided as a cylindrical shape with corresponding terminology.

The second end 84 includes an outer diameter 86, or other outer width dimension for non-cylindrical shapes, larger than the outer diameter 74 of the first end 72, the outer diameter 86 sized large enough to receive the in-floor swimming pool cleaning nozzle 20. Unlike a conventional leading edge of a housing body, the leading edge 76 of the housing body 70 of FIGS. 3A-3E is formed with a tapered end, the outer surface 94 of the wall 90 having a thickness 100 less than ⅛" at the leading edge 96 that is beveled outward from its narrowest point at the leading edge 96 to a thickness 102 that is greater than the thickness at the leading edge 96 as the wall 90 extends away from the leading edge toward the flange 98. The flange 98 extends radially outward from the wall 90 in particular embodiments, such as that shown in FIGS. 4A-4E. In particular embodiments, the flange 98 extends perpendicular to the wall 90. The inner surface 92 of the wall adjacent the leading edge and opposite the beveled portion of the outer surface 94 is non-beveled and parallel to the central axis 88 of the housing body 70. In particular embodiments, the leading edge 96 has a thickness 100 of 1/16" or less. In other particular embodiments, the leading edge 96 has a thickness 100 of 1/32" or less.

The outer surface 54 of the wall 50 is beveled from the leading edge 56 of the wall 50 to a depth 64 on the wall 50 between the leading edge 56 and the flange 58. In some embodiments, the depth 64 on the wall 50 is equal to or greater than a largest thickness of the wall 62 between the leading edge 56 and the flange 58.

In particular embodiments, the thickness 100 at the leading edge 96 is beveled outward through the outer surface 94 to a thickness 102 at least twice as thick as the thickness 100 at the leading edge 96. In some embodiments, the outer surface 94 is gradually beveled at the leading edge 96 from its larger thickness 102 to a narrower thickness 100 at the leading edge 96. In other embodiments, the outer surface 94 may increase in thickness 100, 102, irregularly or not consistently as it extends toward the flange. The outer surface 94 of the wall 90 is beveled from the leading edge 96 of the wall 90 to a depth on the wall 90 between the leading edge 96 and the flange 98. In some embodiments, the depth 104 on the wall 90 is equal to or greater than the largest thickness 102 of the wall 90 between the leading edge 96 and the flange 98. In particular embodiments, that depth 104 is at least half of a distance from the leading edge 96 to the flange 98 (see, for example, FIG. 4D). In other embodiments, the depth 104 is equal to the distance from the leading edge 96 to the flange 98 so that the bevel on the outer surface 94 extends to the flange 98 (see, for example, FIG. 4E). In particular embodiments, the amount of the bevel on the outer surface 94 may vary between a minimum bevel at 45 degrees (FIG. 6A) to a medium bevel (FIG. 6B) to a maximum bevel (FIG. 6C) and anywhere in between. For embodiments where the bevel angle 110 with respect to the plane perpendicular to the outer surface 94 is less than 45 degrees, the plaster 16 of the pool floor may be unstable and tend to crack. Although it is not required in all embodiments, by providing a bevel angle 110 of 45 degrees or more, the plaster 16 is more stable. However, by fully beveling the outer surface 94 of the leading edge 96 all the way to the flange 98, the housing body 70 is least stable due to the thinner wall thickness 102 extending longer near the leading edge 96. Those of ordinary skill in the art will be able to determine an appropriate bevel angle 110 for the materials used for the housing body 70 and the plaster 16.

Figure 4A:
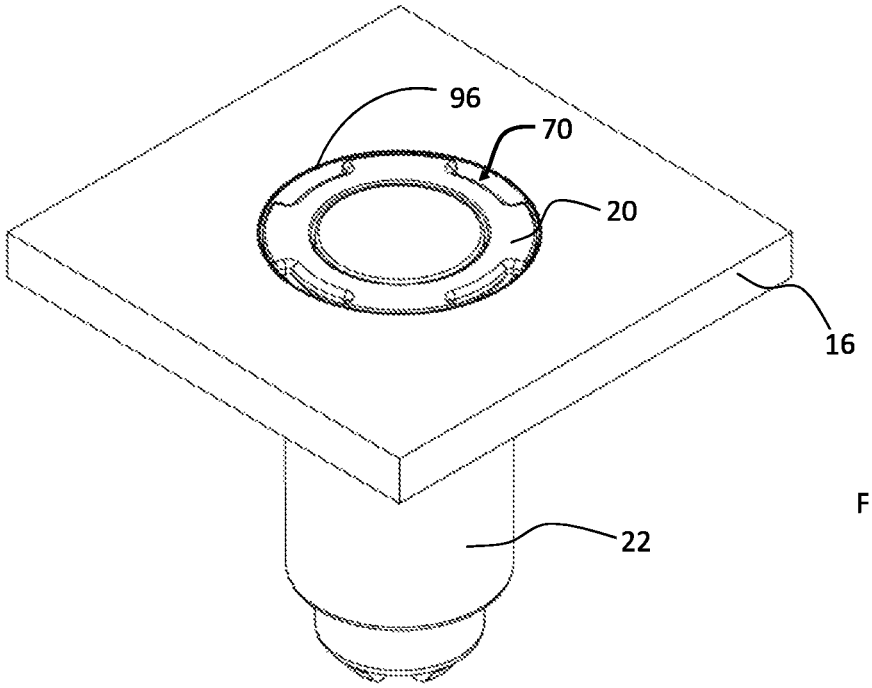
FIG. 4A is an in-floor cleaning nozzle mounted in a swimming pool floor in a second housing embodiment with an externally beveled leading edge.
Figure 4B:
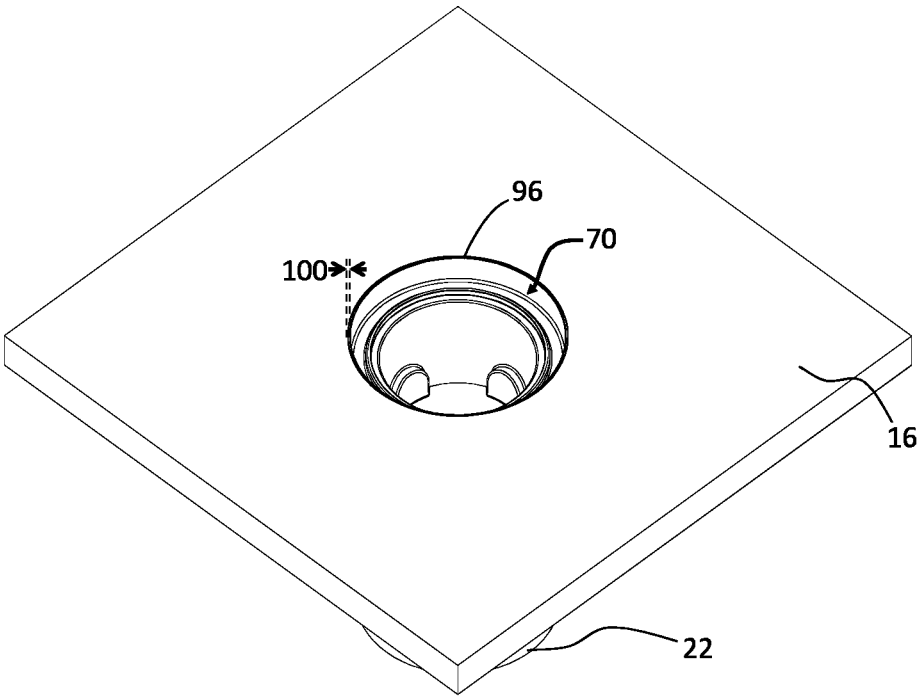
FIG. 4B is a perspective view of the housing of FIG. 4A with the in-floor cleaning nozzle removed.
Figure 4C:
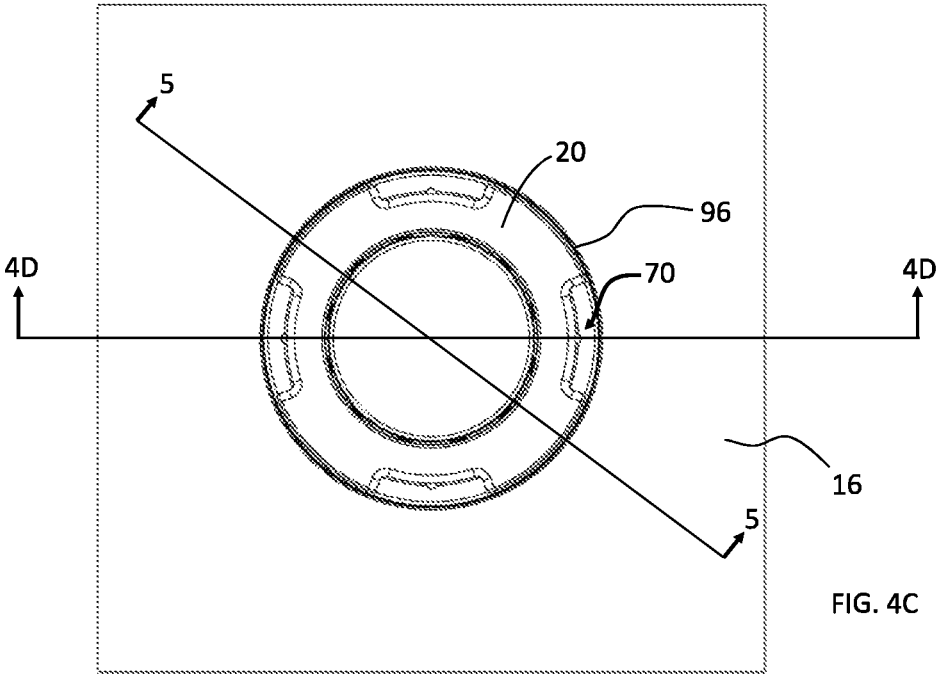
FIG. 4C is a top view of the in-floor cleaning nozzle and housing of FIG. 4A.
Figure 4D:
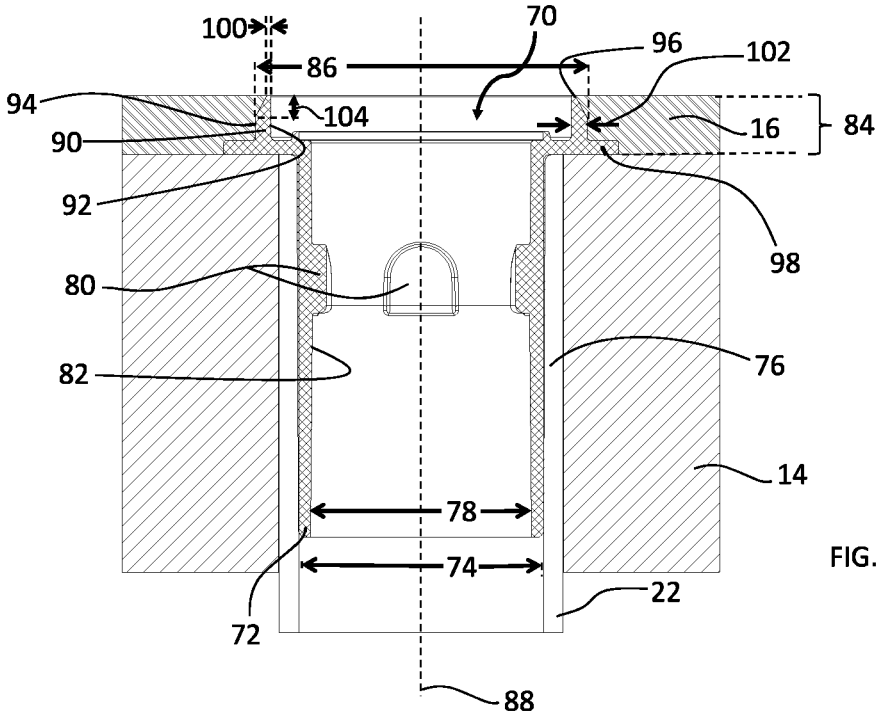
FIG. 4D is a cross-sectional view of the in-floor cleaning nozzle housing of FIG. 4C taken along cross-sectional line 4D-4D emphasizing the externally beveled leading edge of the housing.
Figure 4E:
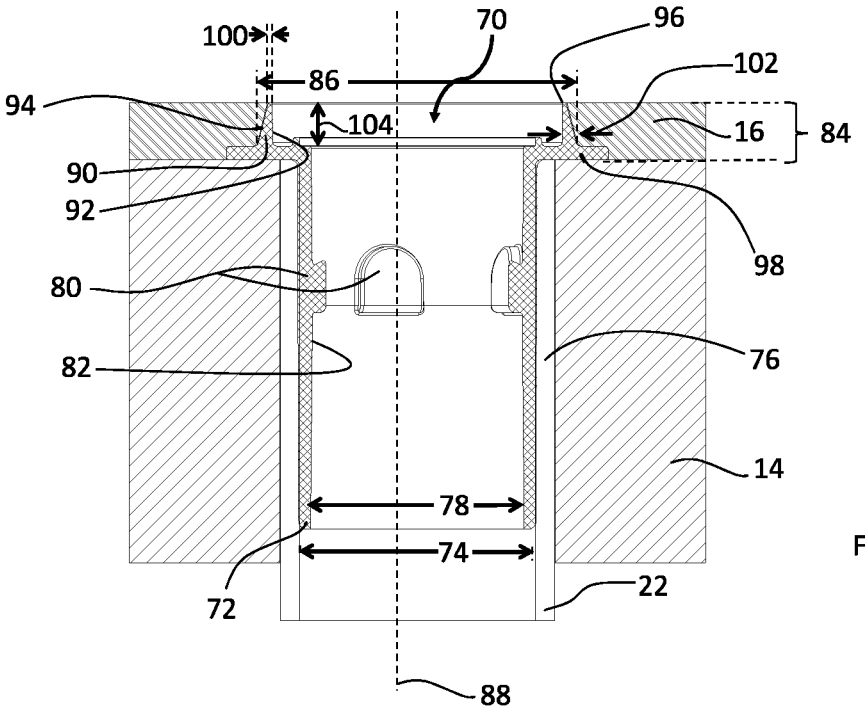
FIG. 4E is a cross-sectional view of the in-floor cleaning nozzle housing of FIG. 4C taken along cross-sectional line 4D-4D emphasizing the externally beveled leading edge of the housing with a steeper bevel than in FIG. 4D.
Figure 5:
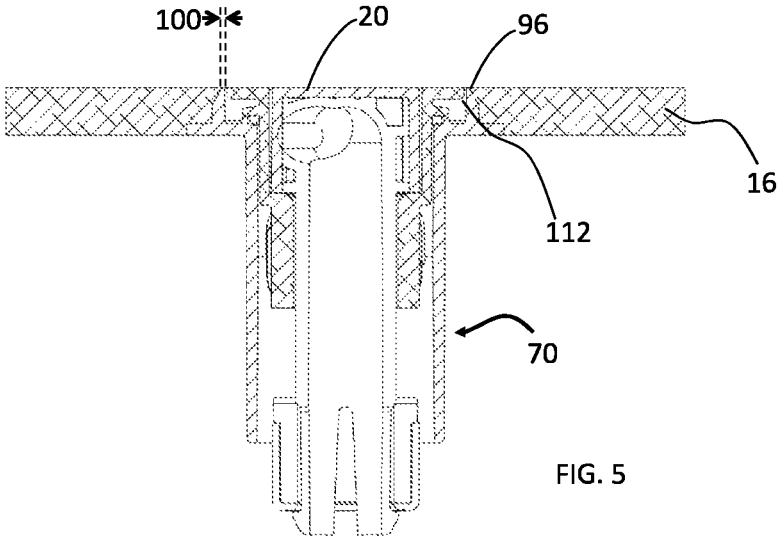
FIG. 5 is a cross-sectional view of the in-floor cleaning nozzle and housing of FIG. 4C taken along cross-sectional line 5-5.

FIG. 5 illustrates a cross-sectional view of the in-floor cleaning nozzle 20 and housing body 70 of FIG. 4C taken along cross-sectional line 5-5. In any embodiment of an in-floor nozzle 20 disclosed herein, as illustrated through the example of FIG. 5, the bottom side of the outer edge 112 may be rounded or otherwise angled to assist in guiding the nozzle 20 into the housing body 70. As further illustrated through the example of FIG. 5, the top surface of the in-floor cleaning nozzle 20 sits within the boundary of the housing 70 opening, within the leading edge 96 of the housing body 70. Because of the narrowed leading edge 96 resulting from the beveled outer surface, the housing body 70 shows very little on the surface of the plaster 16 and the nozzle 20 extends almost to the inner wall of the leading edge 96 without overlapping the leading edge 96 of the housing body 70.

The foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

The invention claimed is:

1. A housing for an in-floor swimming pool cleaning nozzle, consisting essentially of a hollow, single piece molded cylindrical body comprising:

a first end having an outer diameter sized to fit within an end of a swimming pool cleaning system water pressure supply pipe and an inner diameter sized to receive an end of an in-floor swimming pool cleaning nozzle, the first end having a plurality of nozzle connection lugs extending inward of an inner surface of the first end, the plurality of nozzle connection lugs configured to engage corresponding lugs on the in-floor swimming pool cleaning nozzle; and a second end diametrically enlarged compared with the first end and sized to receive an in-floor swimming pool cleaning nozzle, wherein the second end having a wall extending axial to the cylindrical body at the second end and forming a leading edge of the second end, the leading edge having a thickness of ⅛" or less at the leading edge, the wall comprising a flange that extends radially from the cylindrical body, an outer surface of the wall being gradually beveled from the thickness of less than ⅛" at the leading edge to a thickness at least twice as thick as the thickness at the leading edge as the wall extends away from the leading edge toward the flange, an inner surface of the wall adjacent the leading edge being non-beveled and parallel to a central axis of the cylindrical body.

2. The housing for the in-floor swimming pool cleaning nozzle of claim 1, wherein the leading edge of the second end having a thickness of 1/16" or less.

3. The housing for the in-floor swimming pool cleaning nozzle of claim 2, wherein the leading edge of the second end having a thickness of 1/32" or less.

4. The housing for the in-floor swimming pool cleaning nozzle of claim 1, wherein the outer surface of the wall is gradually beveled from the leading edge of the second end to a depth on the wall measured from the leading edge that is less than half of a distance from the leading edge to the flange.

5. The housing for the in-floor swimming pool cleaning nozzle of claim 1, wherein the outer surface of the wall is gradually beveled from the leading edge of the second end to a depth on the wall measured from the leading edge toward the flange that is equal to or greater than a largest thickness of the wall between the leading edge and the flange.

6. The housing for the in-floor swimming pool cleaning nozzle of claim 5, wherein the outer surface of the wall is gradually beveled from the leading edge of the second end until the flange extends radially from the wall.

7. The housing for the in-floor swimming pool cleaning nozzle of claim 1, wherein the wall extends axially toward the first end past the flange such that the flange extends radially from the cylindrical body from the wall.

8. A housing for an in-floor swimming pool cleaning nozzle, the housing comprising a hollow, molded body comprising:

a cylindrical first end having an outer diameter sized to fit within an end of a swimming pool cleaning system water pressure supply pipe and an inner diameter sized to receive an end of an in-floor swimming pool cleaning nozzle, the first end comprising at least one nozzle connector extending inward of an inner surface of the first end, the at least one nozzle connector configured to engage the in-floor swimming pool cleaning nozzle; and a second end wider than the outer diameter of the first end and sized to receive an in-floor swimming pool cleaning nozzle, wherein the second end comprises a wall extending axial to the cylindrical first end and forming a leading edge of the second end, the wall comprising a flange that extends perpendicular to the wall, an outer surface of the wall being beveled from its narrowest point at the leading edge to a thickness greater than the thickness at the leading edge as the wall extends away from the leading edge toward the flange, an inner surface of the wall immediately adjacent the leading edge being non-beveled and parallel to a central axis of the cylindrical body.

9. The housing for the in-floor swimming pool cleaning nozzle of claim 8, wherein the wall of the second end extending toward the flange gradually bevels outward to a thickness of at least twice as large as the thickness at the leading edge.

10. The housing for the in-floor swimming pool cleaning nozzle of claim 8, wherein the leading edge of the second end having a thickness 1/16" or less.

11. The housing for the in-floor swimming pool cleaning nozzle of claim 10, wherein the leading edge of the second end having a thickness of 1/32" or less.

12. The housing for the in-floor swimming pool cleaning nozzle of claim 8, wherein the outer surface of the wall is gradually beveled from the leading edge of the second end to a depth on the wall measured from the leading edge toward the flange that is equal to or greater than a largest thickness of the wall between the leading edge and the flange.

13. The housing for the in-floor swimming pool cleaning nozzle of claim 12, wherein the depth to which the outer surface of the wall is gradually beveled is at least half of a distance from the leading edge to the flange.

14. The housing for the in-floor swimming pool cleaning nozzle of claim 13, wherein the outer surface of the wall is gradually beveled from the leading edge of the second end until the flange extends radially from the wall.

15. The housing for the in-floor swimming pool cleaning nozzle of claim 8, wherein the wall extends axially toward the first end past the flange such that the flange extends perpendicular from the wall.

16. A housing for an in-floor swimming pool cleaning nozzle comprising a hollow, cylindrical body molded as a single piece of material having:

a first end with an outer diameter sized to fit within an end of a swimming pool cleaning system water pressure supply pipe and an inner diameter sized to receive an end of an in-floor swimming pool cleaning nozzle and engage the in-floor swimming pool cleaning nozzle with at least one nozzle connector extending inward from the inner surface of the first end; and a second end with an outer diameter wider than the outer diameter of the first end, the second end forming wall having a leading edge that is beveled on an outer surface of the wall immediately adjacent the leading edge such that a thickness of the wall immediately adjacent the leading edge is less than a thickness of the wall farther from the leading edge, and the leading edge is non-beveled on an inner surface of the wall immediately adjacent the leading edge, the second end further comprising a continuous annular flange extending radially outward of the wall.

17. The housing for the in-floor swimming pool cleaning nozzle of claim 16, wherein the wall of the second end extending toward the flange gradually bevels outward to a thickness of at least twice as large as the thickness at the leading edge.

18. The housing for the in-floor swimming pool cleaning nozzle of claim 16, wherein the leading edge of the second end having a thickness 1/16" or less.

19. The housing for the in-floor swimming pool cleaning nozzle of claim 18, wherein the leading edge of the second end having a thickness of 1/32" or less.

20. The housing for the in-floor swimming pool cleaning nozzle of claim 16, wherein the outer surface of the wall is gradually beveled from the leading edge to a depth on the wall measured from the leading edge toward the flange that is equal to or greater than a largest thickness of the wall between the leading edge and the flange.

* * * * *